US009734747B2

(12) United States Patent
Lee et al.

(10) Patent No.: US 9,734,747 B2
(45) Date of Patent: Aug. 15, 2017

(54) ORGANIC LIGHT EMITTING DIODE DISPLAY APPARATUS AND METHOD FOR DRIVING THE ORGANIC LIGHT EMITTING DIODE DISPLAY APPARATUS

(71) Applicant: LG DISPLAY CO., LTD., Seoul (KR)

(72) Inventors: JoonHee Lee, Seoul (KR); Dongwon Park, Goyang-si (KR); YongChul Kwon, Seoul (KR)

(73) Assignee: LG DISPLAY CO., LTD., Seoul (KR)

( * ) Notice: Subject to any disclaimer, the term of this patent is extended or adjusted under 35 U.S.C. 154(b) by 129 days.

(21) Appl. No.: 14/581,429

(22) Filed: Dec. 23, 2014

(65) Prior Publication Data

US 2015/0187254 A1 Jul. 2, 2015

(30) Foreign Application Priority Data

Dec. 31, 2013 (KR) ..... 10-2013-0168571

(51) Int. Cl.
*G09G 5/10* (2006.01)
*G09G 3/20* (2006.01)
*G09G 3/3233* (2016.01)

(52) U.S. Cl.
CPC ..... *G09G 3/2022* (2013.01); *G09G 3/3233* (2013.01); *G09G 2320/0223* (2013.01)

(58) Field of Classification Search
CPC ..... G09G 3/2011; G09G 5/18; G09G 3/3258
USPC ..... 345/76, 92, 690
See application file for complete search history.

(56) References Cited

U.S. PATENT DOCUMENTS

2006/0092148 A1* 5/2006 Ozawa ..... G09G 3/3233 345/204
2010/0117935 A1 5/2010 Seo et al.
2010/0225675 A1* 9/2010 Takahashi ..... G09G 3/3648 345/690
2014/0118384 A1* 5/2014 Buckley ..... G09G 3/3413 345/589

FOREIGN PATENT DOCUMENTS

CN 1294375 A 5/2001
CN 1333525 A 1/2002
CN 1700282 A 11/2005
EP 1 359 564 B1 11/2005

OTHER PUBLICATIONS

Office Action dated Oct. 24, 2016 for Chinese Application No. 201410858324.9, 6 pages.

* cited by examiner

*Primary Examiner* — Calvin C Ma
(74) *Attorney, Agent, or Firm* — Brinks Gilson & Lione

(57) ABSTRACT

The present invention provides a method for driving an Organic Light Emitting Diode (OLED) display apparatus. The method is for displaying a grayscale of one frame with N (N is a natural number equal to or larger than two) number of sub-frames including a writing period and a light-emitting period. Here, M (M is a natural number equal to or smaller than N) number of the sub-frames among the N number of sub-frames include a non-light-emitting period, and a length of the light-emitting period in a specific sub-frame of which a length of the light-emitting period is the shortest is proportional to a difference between a frame time and a time obtained by multiplying a length of the writing period and M.

12 Claims, 7 Drawing Sheets

ORGANIC LIGHT EMITTING DIODE DISPLAY APPARATUS AND METHOD FOR DRIVING THE ORGANIC LIGHT EMITTING DIODE DISPLAY APPARATUS

CROSS-REFERENCE TO RELATED APPLICATION

This application claims priority from and the benefit under 35 U.S.C. §119(a) of Korean Patent Application No. 10-2013-0168571, filed on Dec. 31, 2013, which is hereby incorporated by reference for all purposes as if fully set forth herein.

BACKGROUND

1. Field of the Disclosure

The present disclosure relates to an organic light emitting diode display apparatus and a method for driving the organic light emitting diode display apparatus.

2. Description of the Prior Art

An Organic Light Emitting Diode (OLED) display apparatus coming into the spotlight as a display apparatus has advantages of a fast response speed, high light emitting efficiency, high luminance and a wide viewing angle because of using an OLED which emits light by itself.

The OLED display apparatus is divided into a passive matrix type, an active matrix type and so on, according to a driving manner.

Among these, in the active matrix type OLED display apparatus, a scan signal, a data signal, a driving power and so on are provided to a plurality of pixels disposed in a matrix shape, a selected pixel emits light, and thus an image may be displayed.

A driving method of the OLED display apparatus for displaying the image includes a voltage driving manner, a current driving manner, a digital driving manner, etc. Among these manners, the digital driving manner displays one frame grayscale with a plurality of sub-frames. For example, in case of displaying the image with 32 grayscales, the one frame may be divided into five sub-frames. The OLED display apparatus sets a weighted value (e.g a binary weight) of a corresponding sub-frame by controlling a light-emitting period in each of the sub-frames. For example, the OLED display apparatus sets each of the sub-frames so that the weighted values of each of the sub-frames are 1, 2, 4, 8 and 16 according to an antilogarithm of 2, after the manner of setting the weighted value of a first sub-frame as 1 and setting the weighted value of a first sub-frame next to the first sub-frame as 2. The OLED display apparatus displays the one frame grayscale by combining the sub-frames of which the weighted value is differently set according to the light-emitting period.

In the digital driving manner, the sub-frame may be divided into a writing period and the light-emitting period. The OLED display apparatus selects a scan line in the writing period and provides the driving power to pixels of the selected scan lines. At this time, a length of the writing period may be fixed, but a length of the light-emitting period is differently set according to the weighted values of each of the sub-frames. For example, the length of the light-emitting period of the sub-frame of which the weighted value is four is four times of the length of the light-emitting period of the sub-frame of which the weighted value is one.

Among the light-emitting periods having different lengths, the length of the light-emitting period may be shorter than the length of the writing period. For example, when the length of the writing period is 2 unit times and the length of the light-emitting period in the sub-frame of which the weighted value is 4 is 2 unit times, the length of the light-emitting period in the sub-frame of which the weighted value is 2 is 1 unit time, and the length of the light-emitting period in the sub-frame of which the weighted value is 1 is 0.5 unit time. At this time, the length of the light-emitting period in the sub-frame of which the weighted value is 2 and the length of the light-emitting period in the sub-frame of which the weighted value is 1 are shorter than the length of the writing period (it is assumed that the length of the writing period is fixed to 2 unit times).

In a specific sub-frame, when the length of the light-emitting period is shorter than the length of the writing period, a non-light-emitting period is generated in the corresponding sub-frame. The OLED display apparatus selects the scan lines one by one in the writing period. Therefore, although the light-emitting period of a corresponding scan line is finished, the OLED display apparatus becomes a non-light-emitting state wherein the OLED display apparatus cannot emit light until the writing period with respect to all scan lines is ended.

Since one frame time is finite, it is necessary to minimize the length of the non-light-emitting period, and to optimize the lengths of the light-emitting period and the writing period.

SUMMARY

A method is provided for driving an Organic Light Emitting Diode (OLED) display apparatus. The method is for displaying a grayscale of one frame with N (N is a natural number equal to or larger than two) number of sub-frames including a writing period and a light-emitting period. Here, M (M is a natural number equal to or smaller than N) number of the sub-frames among the N number of sub-frames include a non-light-emitting period, and a length of the light-emitting period in a specific sub-frame of which a length of the light-emitting period is the shortest is proportional to a difference between a frame time and a time obtained by multiplying a length of the writing period and M.

As described above, according to the present invention, lengths of each of periods in a sub-frame are optimized, and thus an OLED display apparatus may be effectively driven.

BRIEF DESCRIPTION OF THE DRAWINGS

The above and other objects, features and advantages of the present invention will be more apparent from the following detailed description taken in conjunction with the accompanying drawings, in which.

DETAILED DESCRIPTION OF THE EXEMPLARY EMBODIMENTS

Figure 1:
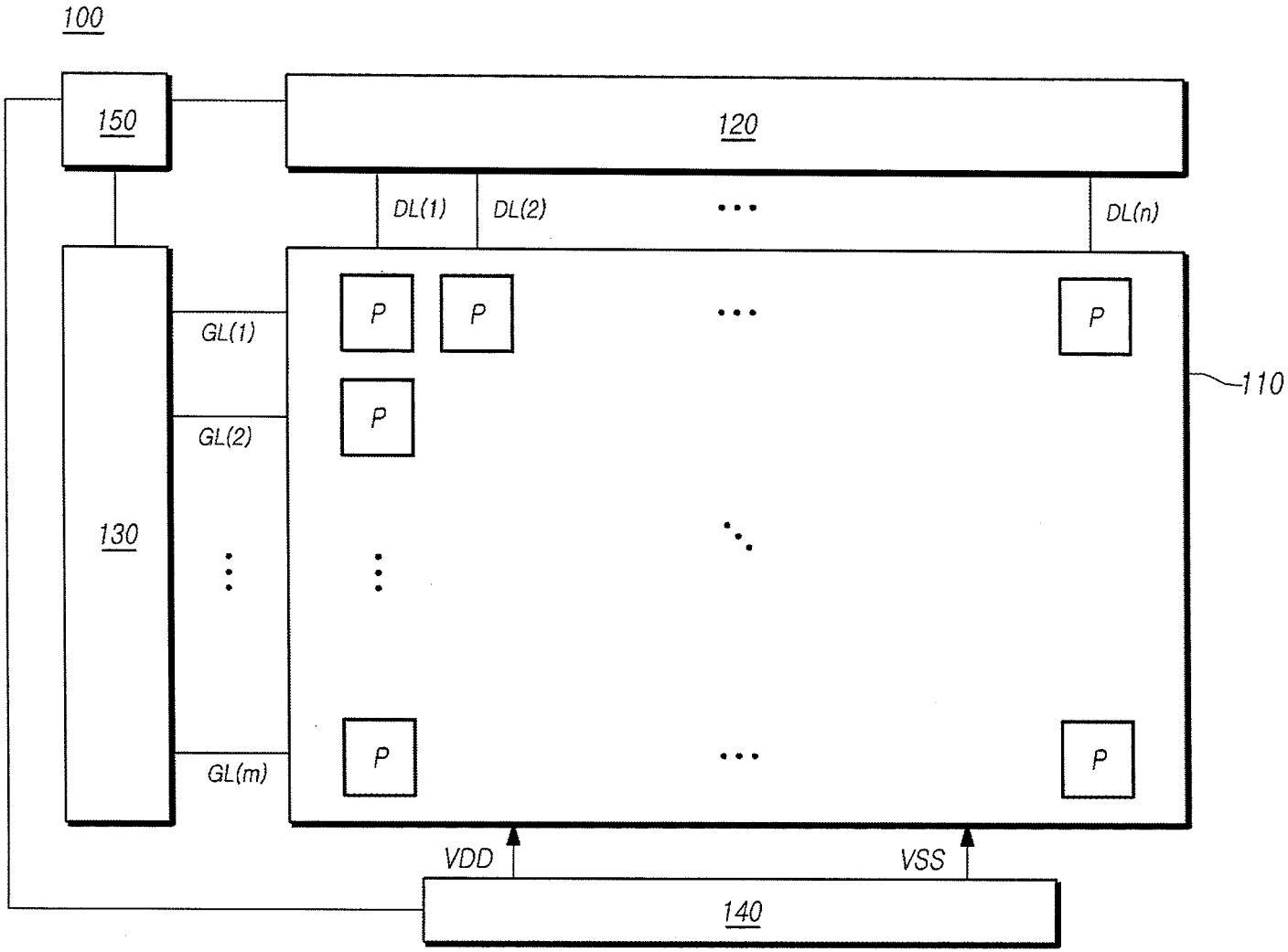
FIG. 1 is a schematic view illustrating an Organic Light Emitting Diode (OLED) display apparatus to which exemplary embodiments of the present disclosure are applied.

Hereinafter, exemplary embodiments of the present invention will be described with reference to the accompanying drawings. In the following description, the same elements will be designated by the same reference numerals although they are shown in different drawings. Further, in the following description of embodiments of the present invention, a detailed description of known functions and configurations incorporated herein will be omitted when it may make the subject matter of the present invention rather unclear.

In addition, terms, such as first, second, A, B, (a), (b) or the like may be used herein when describing components of the present invention. These terms are merely used to distinguish one structural element from other structural elements, and a property, an order, a sequence and the like of a corresponding structural element are not limited by the term. It should be noted that if it is described in the specification that one component is "connected," "coupled" or "joined" to another component, a third component may be "connected," "coupled," and "joined" between the first and second components, although the first component may be directly connected, coupled or joined to the second component. Likewise, when it is described that a certain element is formed "on" or "under" another element, it should be understood that the certain element may be formed either directly or indirectly via a still another element on or under another element.

FIG. 1 is a schematic view illustrating an Organic Light Emitting Diode (OLED) display apparatus to which exemplary embodiments of the present disclosure are applied.

Referring to FIG. 1, the OLED display apparatus (hereinafter, referred to as a "display apparatus") includes a display panel 110, a data driving unit 120, a gate driving unit 130, a power supplying unit 140, a timing controller 150, etc.

In the display panel 110, data lines DL1, DL2, . . . , and DLn and gate lines GL1, GL2, . . . , and GLm are formed. A plurality of pixels P are defined by a crossing of the data lines DL1, DL2, . . . , and DLn and the gate lines GL1, GL2, . . . , and GLm formed on the display panel 110.

The data driving unit 120 provides a data voltage to the data line DL1, DL2, . . . , and DLn.

The gate driving unit 130 sequentially provides a scan signal to the gate lines GL1, GL2, . . . , and GLm.

The power supplying unit 140 provides a high potential voltage VDD and a low potential voltage VSS to the pixels.

The timing controller 150 controls driving timings of the data driving unit 120, the gate driving unit 130 and the power supplying unit 140, and outputs various control signals for the control of the driving timings.

The gate driving unit 130 may be positioned on only one side of the display panel 110 as illustrated in FIG. 1 or may be divided into two and positioned on both sides of the display panel 110, depending on a driving type of the gate driving unit 130. In addition, the gate driving unit 130 may include a plurality of gate driving integrated circuits (ICs). The plurality of gate driving ICs may be connected to a bonding pad of the display panel 110 in a Tape Automated Bonding (TAB) manner or a Chip On Glass (COG) manner. Alternatively, the plurality of gate driving ICs may be directly formed on the display panel 110 in a Gate In Panel (GIP) type.

The data driving unit 120 may include a plurality of data driving ICs (may be referred to as a source driving IC). The plurality of data driving ICs may be connected to the bonding pad of the display panel 110 in the TAB manner or the COG manner. Alternatively, the plurality of data driving ICs may be directly formed on the display panel 110 in the GIP type.

Each of the pixels P is connected to the data line DL, the gate line GL, etc. Structures of each of the pixels P are described in more detail with reference to FIG. 2.

Figure 2:
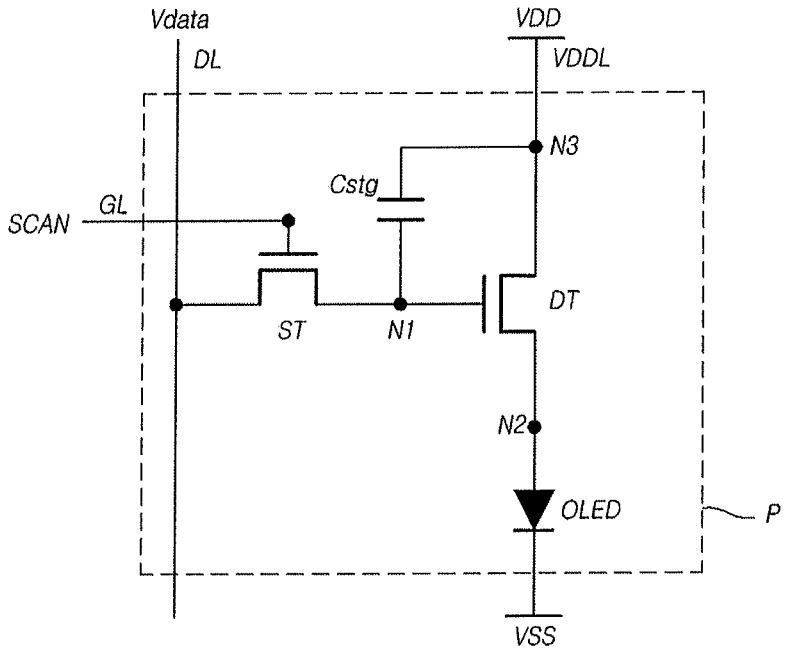
FIG. 2 is an equivalent circuit diagram illustrating one pixel of the display apparatus in FIG. 1.

FIG. 2 is an equivalent circuit diagram illustrating one pixel P of the display apparatus 100 in FIG. 1.

Referring to FIG. 2, one pixel P of the display apparatus 100 includes an OLED and a driving circuit unit for driving the OLED.

Referring to FIG. 2, the driving circuit unit for driving the OLED in each of the pixels P includes a driving transistor DT, a switching transistor ST, a storage capacitor Cstg, etc. The driving transistor is for providing a current to the OLED OLED. The switching transistor ST controls a turn-on or a turn-off of the driving transistor DT by controlling an appliance of a data voltage to a first node N1 of the driving transistor DT due to a control according to the scan signal. The storage capacitor Cstg maintains the data voltage applied to the first node N1 of the driving transistor DT during one frame.

Referring to FIG. 2 in succession, the driving transistor DT has three nodes N1, N2 and N3 as a transistor for driving the OLED OLED. The first node N1 is connected to the switching transistor ST. The second node N2 is connected to an anode (or a cathode) of the OLED OLED. The third node N3 is connected to a high potential voltage line VDDL to which the high potential voltage VDD is provided.

The switching transistor ST is controlled by the scan signal SCAN provided from the gate line GL. The switching transistor ST is connected between the data line DL and the first node N1 of the driving transistor DT. The switching transistor ST applies a data voltage Vdata provided from the data line DL to the first node N1 of the driving transistor DT.

The storage capacitor Cstg is connected between the first node N1 of the driving transistor DT and the third node N3 of the driving transistor DT.

The driving transistor DT may be an N type transistor, or may be a P type transistor. When the driving transistor DT is the N type transistor, the first node N1 may be a gate node, the second node N2 may be a source node, and the third node N3 may be a drain node. When the driving transistor DT is the P type transistor, the first node N1 may be the gate node, the second node N2 may be the drain node, and the third node N3 may be the source node. But, hereinafter, for convenience of description, it is assumed that each of the driving transistor DT, a first transistor T1 and a second transistor T2 connected to the driving transistor DT is the P type transistor, and thus it is assumed that the first node N1 of the driving transistor DT is the gate node, the second node N2 of the driving transistor DT is the drain node, and the third node N3 of the driving transistor DT is the source node.

When the display apparatus 100 is operated in a current driving manner, the display apparatus 100 displays the grayscale by controlling a luminance of the OLED OLED by controlling a pixel current IOLED. The display apparatus 100 may be operated in a digital driving manner.

Figure 3:
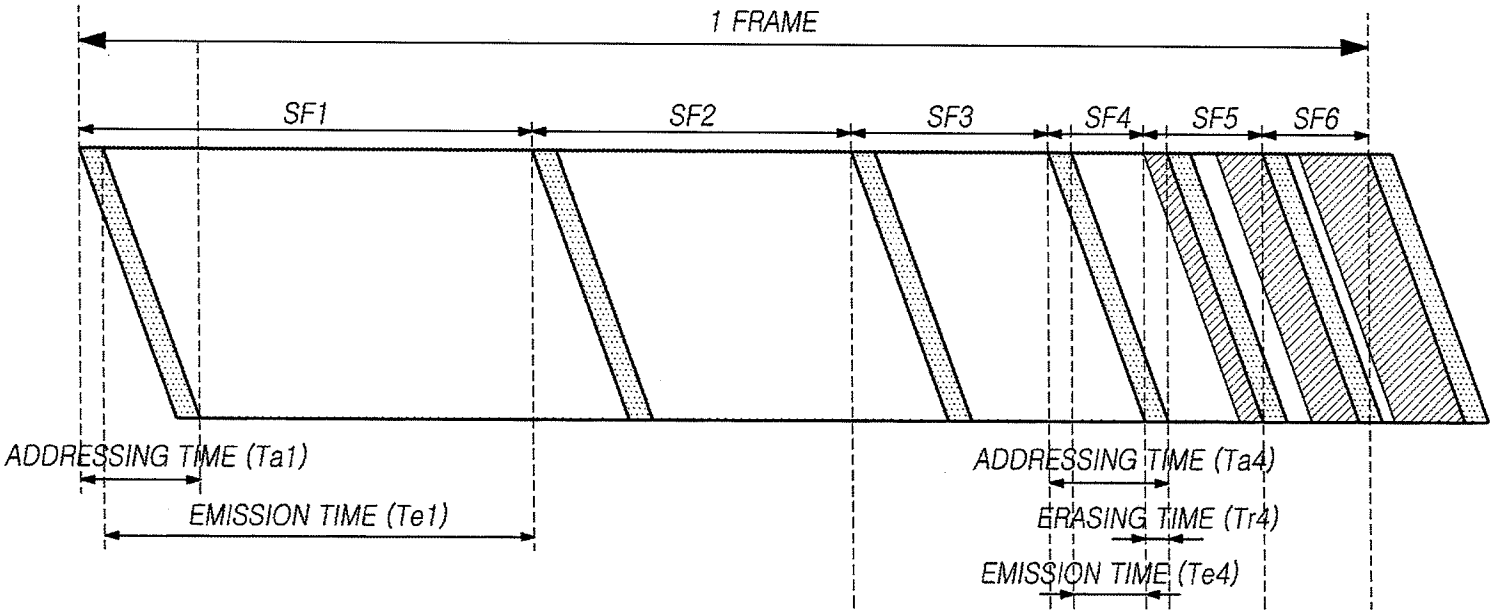
FIG. 3 is a view illustrating sub-frames forming one frame in a digital driving manner.
Figure 4:
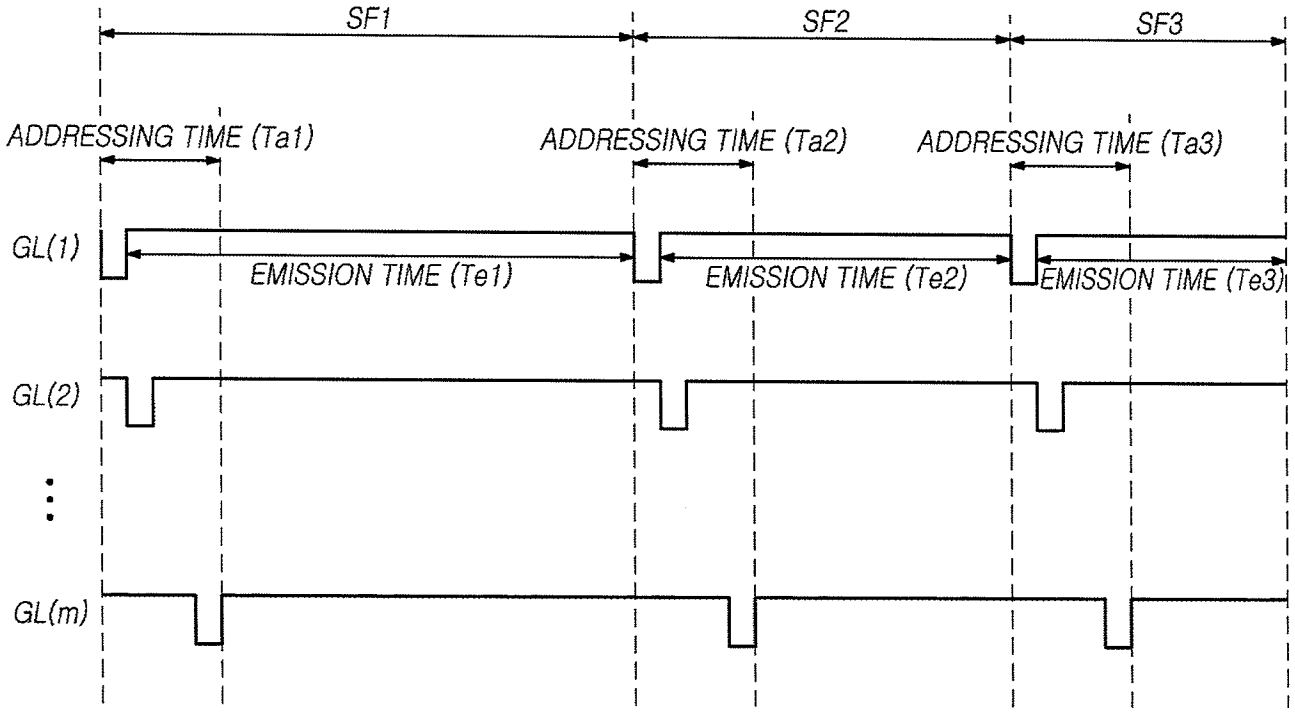
FIG. 4 is a view for describing a writing period and a light-emitting period in the sub-frame.

FIG. 3 is a view illustrating sub-frames forming the one frame in the digital driving manner, and FIG. 4 is a view for describing a writing period and a light-emitting period in the sub-frame.

Referring to FIG. 3, the display apparatus 100 divides the one frame into 6 sub-frames to drive the one frame. Since the six sub-frames are united, the grayscale of the one frame is displayed. For example, in relation to a number of the sub-frames shown in FIG. 3, the display apparatus 100 may display the grayscale of the one frame by driving N (N is a natural number equal to or larger than two) number of sub-frames.

In the digital driving manner, a plurality of sub-frames are united, and thus the grayscale of the one frame is displayed. For example, when an image is displayed with sixty four grayscales, the one frame may include 6 sub-frames. At this time, the display apparatus 100 may set a weighted value of a corresponding sub-frame by controlling the light-emitting period of each of the sub-frames. For example, the display apparatus 100 may set each of the sub-frames so that the weighted value is 1, 2, 4, 8, 16 and 32 according to an antilogarithm of 2, after the manner of setting the weighted value of a first sub-frame as 32 and setting the weighted value of a second sub-frame as 16. The display apparatus 100 displays the grayscale of the one frame by combining the sub-frames of which the weighted values are differently set according to the above-mentioned light-emitting period. For example, in order to display a grayscale of 23, the display apparatus 100 may control to turn on sub-fields of which the weighted values are 1, 2, 4, and 16 (1+2+4+16=23) and to turn off sub-fields of which the weighted values are 8 and 32. In such a digital driving manner, luminances of the OLED in each of the sub-frames may be the same and lengths of the light-emitting periods in each of the sub-frames may be different.

Referring to FIG. 4, in the sub-frame, the display apparatus 100 provides the scan signal SCAN to each of the gate lines GL1, GL2, . . . , and GLm and provides a driving voltage to the pixels to which the scan signal is provided. Here, the writing time (may be referred to as an addressing time) Ta indicates a time when all of the scan signals are provided to whole of the gate lines GL1, GL2, . . . , and GLm from each of the sub-frames. The light-emitting period (may be referred to as an emission time) Te indicates a time when the pixels are emit in each of the sub-frames.

Referring to FIG. 4, in a first sub-frame SF1, the display apparatus 100 provides the scan signal to a first gate line GL1, provides the data voltage to the pixels connected to the first gate line GL1 to enable the pixels connected to the first gate line GL1 to emit. At this time, the pixels connected to the first gate line GL1 emit during a length of a first emitting period Te1.

The display apparatus 100 sequentially selects the gate lines to provide the scan signal to the gate lines during a writing period Ta1 of the first sub-frame SF1. Referring to FIG. 4, when the scan signal provision is ended with respect to the first gate line GL1, the scan signal is provided to a second gate line GL2 which is the next gate line, continuously the scan signal is provided to the next gate lines, and thus the scan signal is provided up to the last gate line GLm. At this time, each of all of the light-emitting periods of the pixels connected to each of the gate lines in the first sub-frame SF1 is the first light-emitting period Te1.

When the first light-emitting period Te1 of the first gate line GL1 is ended, a writing period Ta2 in a second sub-frame SF2 is started. At this time, the display apparatus 100 can not start the writing period Ta2 of the second sub-frame SF2 before the writing period Ta1 of the first sub-frame is ended. However, the display apparatus 100 may start the writing period Ta2 of the second sub-frame SF2, before the light-emitting period Te1 with respect to other gate lines except for the first gate line GL1 is ended. Referring to FIG. 4, the display apparatus 100 is starting the writing period Ta2 of the second sub-frame SF2, in a state wherein from a second gate line GL2 to the last gate line GLm are in the light-emitting period Te1. As described above, the display apparatus 100 may effectively use a finite frame time by setting the writing period Ta of the next sub-frame so that the writing period Ta of the next sub-frame overlaps the light-emitting period Te of a previous sub-frame. In a third sub-frame SF3 too, the display apparatus 100 is starting a writing period Ta3 before a light-emitting period Te2 with respect to gate lines except for the first gate line GL1 is ended.

The display apparatus 100 controls lengths of the light-emitting periods Te in each of the sub-frames so that the lengths of the light-emitting periods Te in each of the sub-frames are different. Referring to FIGS. 3 and 4, the length of the first light-emitting period Te1 is the longest, and the lengths are shorter in an order of the second light-emitting period Te2 and a third light-emitting period Te3.

Differently from the light-emitting period Te, the lengths of the writing periods Ta in each of the sub-frames may be substantially equal. The display apparatus 100 sequentially selects the gate lines GL1, GL2, . . . , and GLm in the writing period Ta, and thus the writing periods Ta of each of the sub-frames may have substantially the equal time.

A partial sub-frame among the sub-frames may include an non-light-emitting period (may be referred to as an erasing time) Tr. Referring to FIG. 3, a fourth sub-frame SF4, a fifth sub-frame SF5 and a sixth sub-frame SF6 includes the non-light-emitting period Tr.

Referring to FIG. 3, in the fourth sub-frame SF4, a light-emitting period Te4 is shorter than a writing period Ta4. Thus, before the scan signal is provided to the last gate line GLm, the light-emitting period Te4 with respect to the first gate line GL1 is ended. The display apparatus 100 may start the writing period of the next sub-frame before the light-emitting period with respect to the other gate lines except for the first gate line GL1 is ended. However, the display apparatus 100 can not drive so that the writing period of the previous sub-frame and the writing period of the next sub-frame overlap. Referring to FIG. 3, the display apparatus 100 inserts the non-light-emitting period into the corresponding sub-frame in such a way that the writing period of the previous sub-frame and the writing period of the next sub-frame do not overlap in the sub-frame of which the light-emitting period is shorter than the writing period.

A time of the one frame is finite. For example, the time of the one frame is about 16.67 ms. In such a finite time of the one frame, it is necessary to optimally calculate and place the above-mentioned writing period, the light-emitting period and the non-light-emitting period.

First, a method for optimally calculating the length of the writing period Ta is described.

When a signal is applied to a circuit including a resistance element and a capacitance element, an RC delay time is generated. The RC delay is a phenomenon wherein a charge and a discharge with respect to the capacitance element connected to the circuit in series are delayed due to an effect of the resistance element.

When the display apparatus 100 provides the scan signal to one scan signal too, the RC delay time is generated.

Figure 5:
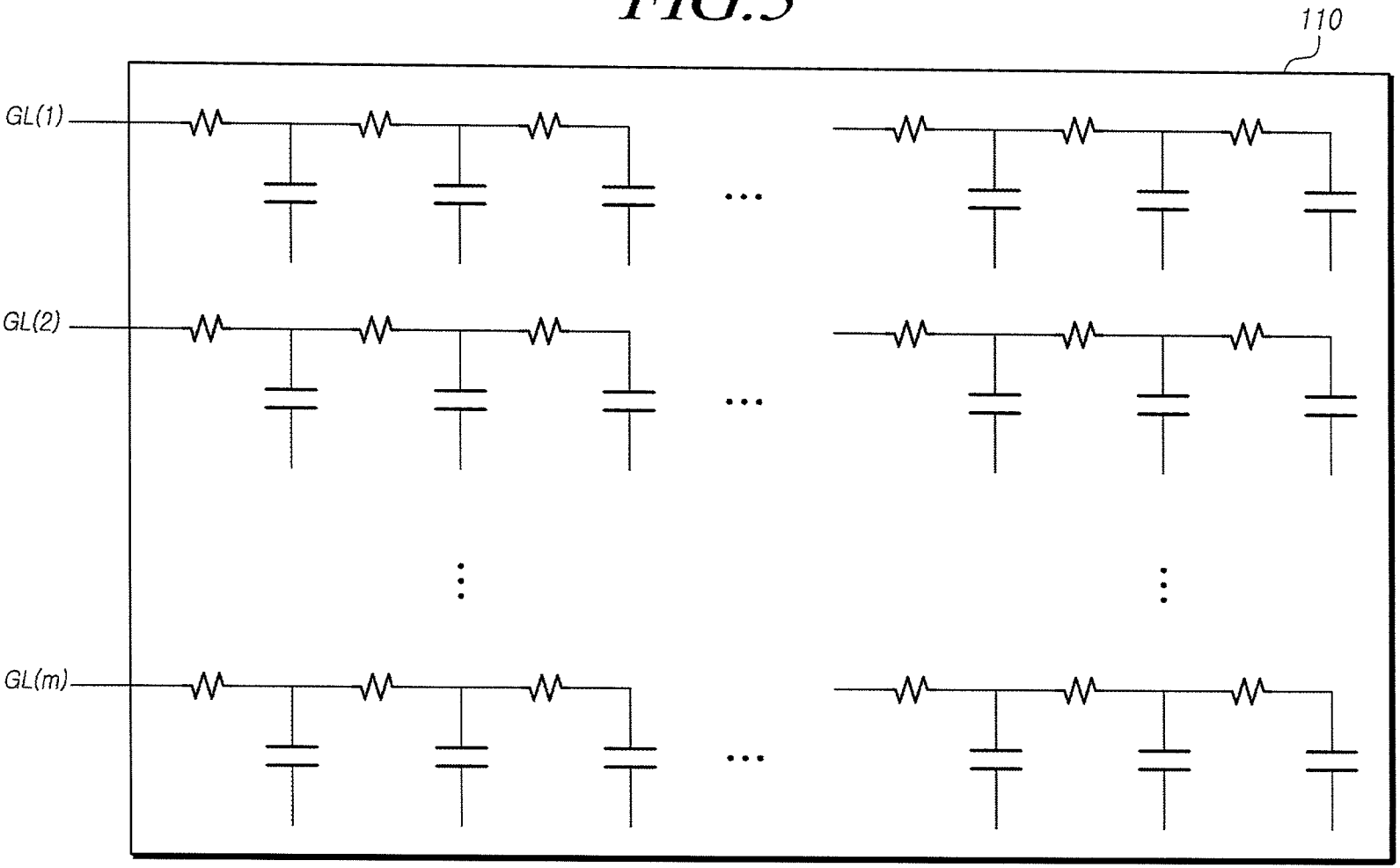
FIG. 5 is a circuit diagram obtained by modeling a resistance element and a capacitance element in a gate line.

FIG. 5 is a circuit diagram obtained by modeling the resistance element and the capacitance element in the gate line.

Referring to FIG. 5, a plurality of the resistance elements are connected in series in the first gate line GL1, and line resistances of the first line GL1, a gate resistance of the switching transistor ST and so on may form such a resistance element (refer to FIG. 2). In addition, a plurality of capacitance elements are connected in parallel in the first gate line GL1, and a capacitance between the gate line GL and the data line DL, a capacitance between the gate and the source of the switching transistor ST and so on may form such a capacitance element (refer to FIG. 2). Referring to FIG. 5 continuously, similarly to the first gate line GL1, each of the second gate line GL2 to the $m^{th}$ gate line GLm is modeled as a circuit in which the plurality of resistance elements and the plurality of capacitance elements are connected in series and in parallel.

The plurality of resistance elements and the plurality of capacitance elements in one gate line may be substituted by an equivalent resistance and an equivalent capacitance, respectively. When the RC time constant of one gate line is calculated by using the equivalent resistance and the equivalent capacitance, the RC time constant may be calculated by the following equation 1.

$$\tau = R_{row} \times C_{row} \qquad \text{Equation 1}$$

In equation 1, $\tau$ is an RC time constant, $R_{row}$ is the equivalent resistance of one gate line, and $C_{row}$ is the equivalent capacitance of one gate line.

$R_{row}$ and $C_{row}$ are values measured through a meter machine. In addition, $R_{row}$ and $C_{row}$ may be calculated by using a number of the pixels connected to one gate line.

$$R_{row} = 1920 \times R_{gate} + R_{extra}$$

$$C_{row} = 1920 \times C_{gate} + C_{extra} \qquad \text{Equation 2}$$

$R_{row}$ may be calculated by adding a total of each of pixel equivalent resistance ($R_{gate}$) connected to one gate line and an additional resistance element ($R_{extra}$, e.g., a resistance element of a most outer area of the display panel 110, a resistance element of a pad portion, etc.). Equation 2 is an example wherein 1920 pixels are connected to one gate line.

$C_{row}$ may be calculated by adding a total of each of pixel equivalent capacitance ($C_{gate}$) connected to one gate line and an additional capacitance element ($C_{extra}$, e.g., a capacitance element of the most outer of the display panel 110, etc.). Equation 2 is the example wherein the 1920 pixels are connected to one gate line.

A voltage formed in the gate line according to the RC time constant (i) determined by the above-mentioned equivalent resistance and equivalent capacitance is calculated by the following equation 3.

$$v(t) = v_o \times (1 - e^{-\frac{t}{\tau}}) \qquad \text{Equation 3}$$

In equation 3, v(t) is a voltage formed in the gate line, and $v_o$ is a voltage of the scan signal provided to the gate line.

When the voltage of the gate line is equal to or larger than a predetermined value, the display apparatus 100 provides a driving voltage to the pixels to enable the pixels to emit. A time point when the display apparatus 100 provides the driving voltage to the pixels may be calculated by the following equation 4.

$$t_{addr(1H)} = -\tau \times \ln\frac{(v_o - v_{addr(1H)})}{v_o} \qquad \text{Equation 4}$$

In equation 4, taddr(1H) is a time from a time point when the display apparatus 100 provides the scan signal to the gate line to a time point when the display apparatus 100 provides the driving voltage to the pixels, and $v_{addr(1H)}$ is the voltage of the gate line at time point when the display apparatus 100 provides the driving voltage to the pixels.

Equation 4 is obtained by readjusting equation 3 with respect to a time and substituting v(t) by $v_{addr(1H)}$.

The writing time with respect to one gate line is determined by equation 4, and thus the writing period ($T_a$) in one sub-frame may be calculated by equation 5.

$$T_a = 1080 \times t_{addr(1H)} \qquad \text{Equation 5}$$

In equation 5, Ta is the length of the writing period. FIG. 5 is an example wherein the display panel 110 includes 1080 pixels in a vertical direction. The display panel 110 may further include a blank line (i.e. a vertical blank). At this time, the length of the writing period may be determined by further adding a number of the blank lines.

$$T_a = (1080+45) \times t_{addr(1H)} \qquad \text{Equation 6}$$

Equation 6 is an example wherein 45 blank lines are further applied in equation 5.

The method for optimally calculating the writing period ($T_a$) has been described with reference to equations 1 to 6. According to above, the length of the writing period ($T_a$) is proportional to the equivalent resistance ($R_{row}$) and the equivalent capacitance ($C_{row}$) of the gate line. In addition, the length of the writing period ($T_a$) is proportional to the RC time constant ($\tau$) of the gate line.

A maximum number of the sub-frames in the one frame is determined by the length of the writing period ($T_a$). When the light-emitting period Te is shorter than the writing period ($T_a$), a length of a corresponding sub-frame is substantially equal to the length of the writing period ($T_a$).

$$T_{SF} = T_a + T_{addr(1H)} \qquad \text{Equation 7}$$

In equation 7, $T_{SF}$ is a length of the sub-frame of which the light-emitting period Te is shorter than the writing period ($T_a$). In equation 7, a length of $T_{addr(1H)}$ is shorter than the writing period ($T_a$). For example, when refer to FIG. 5, the length of the $T_{addr(1H)}$ corresponds to 1/1080 of the writing period ($T_a$). The length of the $T_{addr(1H)}$ indicating such a comparatively small value may be disregarded in engineering.

$$T_{SF} = T_a \qquad \text{Equation 8}$$

Equation 8 is obtained by disregarding the value of $T_{addr(1H)}$.

In the equations below, the value of $T_{addr(1H)}$ indicating comparatively small value is disregarded. Hereinafter, it should be considered that the value of $T_{addr(1H)}$ is disregarded in engineering in an expression of "substantially equal".

Referring to equation 8, a minimum length of one sub-frame is equal to the length of the writing period ($T_a$). Thus, the maximum number of the sub-frames in the one frame is calculated by equation 9.

$$N_{max} = \frac{T_{frame}}{T_a} \qquad \text{Equation 9}$$

In equation 9, $N_{max}$ is the maximum number of the sub-frames in the one frame, and $T_{frame}$ is the one frame time. Referring to equation 9, the number (N) of the subframe displaying the one frame is equal to or smaller than a value obtained by dividing the frame time ($T_{frame}$) by the length of the writing period ($T_a$).

Next, a method for calculating the length of the light-emitting period is described.

The length of the light-emitting period of each of the sub-frames is determined by multiplying the minimum light-emitting period and an antilogarithm of two. For example, when the light-emitting period in the sub-frame having the minimum light-emitting period is 1 unit time, the length of the light-emitting period of other sub-frames are 2 unit times, 4 unit times, 8 unit times, 16 unit times and 32 unit times.

When the number of the sub-frames is 8 and the length of the light-emitting period is longer than the length of the writing period in all of the sub-frames, the one frame time is calculated by equation 10.

$$T_{frame}=128x+64x+32x+16x+8x+4x+2x+x+8\times t_{addr(1H)} \quad \text{Equation 10}$$

In equation 10, x is the length of the light-emitting period (hereinafter, referred to as a "unit light-emitting period") in the sub-frame of which the length of the light-emitting period is the shortest.

Readjusting equation 10, after disregarding the value of $T_{addr(1H)}$ in equation 10, equation 11 is obtained.

$$T_{frame}=128x+64x+32x+16x+8x+4x+2x+x \quad \text{Equation 11}$$

Referring to equation 8, the length of the sub-frame of which the length of the light-emitting period is shorter than the length of the writing period is identical to the length of the writing period. When the sub-frame of which the length of the light-emitting period is shorter than the length of the writing period is one, equation 11 is changed to equation 12.

$$T_{frame}=128x+64x+32x+16x+8x+4x+2x+1\times T_a \quad \text{Equation 12}$$

When the number of the sub-frames of which the length of the light-emitting period is shorter than the length of the writing period is M (M is a natural number equal to or smaller than N), equation 12 is changed to equation 13.

$$T_{frame} = \frac{128x(1-0.5^{(8-M)})}{1-0.5} + M\times T_a \quad \text{Equation 13}$$

Readjusting equation 13 with respect to x, equation 14 is obtained.

$$x = \frac{0.5\times(T_{frame}-M\times T_a)}{128\times(1-0.5^{(8-M)})} \quad \text{Equation 14}$$

Referring to equation 14, the length of the unit light-emitting period (x) is proportional to a difference between the frame time (Tframe) and a time obtained by multiplying the length of the writing period and M (M*Ta).

In equations 10 to 14, for convenience of understanding, the number of the sub-frames was 8, but when the number of the sub-frames is normalized, equation 15 is obtained.

$$x = \frac{0.5\times(T_{frame}-M\times T_a)}{2^{(N-1)}\times(1-0.5^{(N-M)})} \quad \text{Equation 15}$$

More readjusting equation 15, equation 16 is obtained.

$$x = \frac{T_{frame}-M\times T_a}{2^N-2^M} \quad \text{Equation 16}$$

Referring to equation 16, the length (x) of the unit light-emitting period is inversely proportional to a difference between 2N and 2M.

According to equation 16, when the number (N) of the sub-frame, M which is the number of sub-frames including the non-light-emitting period, the frame time (Tframe) and the length of the writing period (Ta) are known, the length (x) of the unit light-emitting period is known.

Inversely, when the length of the unit light-emitting period (x) is known, the number of the sub-frames of which the light-emitting period is shorter than the writing period.

The length of the writing period (Ta) may be calculated by equations 1 to 6, and the one frame time (Tframe) is a determined value which is determined according to a driving frequency (e.g. 60 Hz or 120 Hz), therefore, when the number (N) of the sub-frames is determined, unknown variable values are limited to the length of the unit light-emitting period (x) and the number (M) of the sub-frames including the non-light-emitting period.

Figure 6:
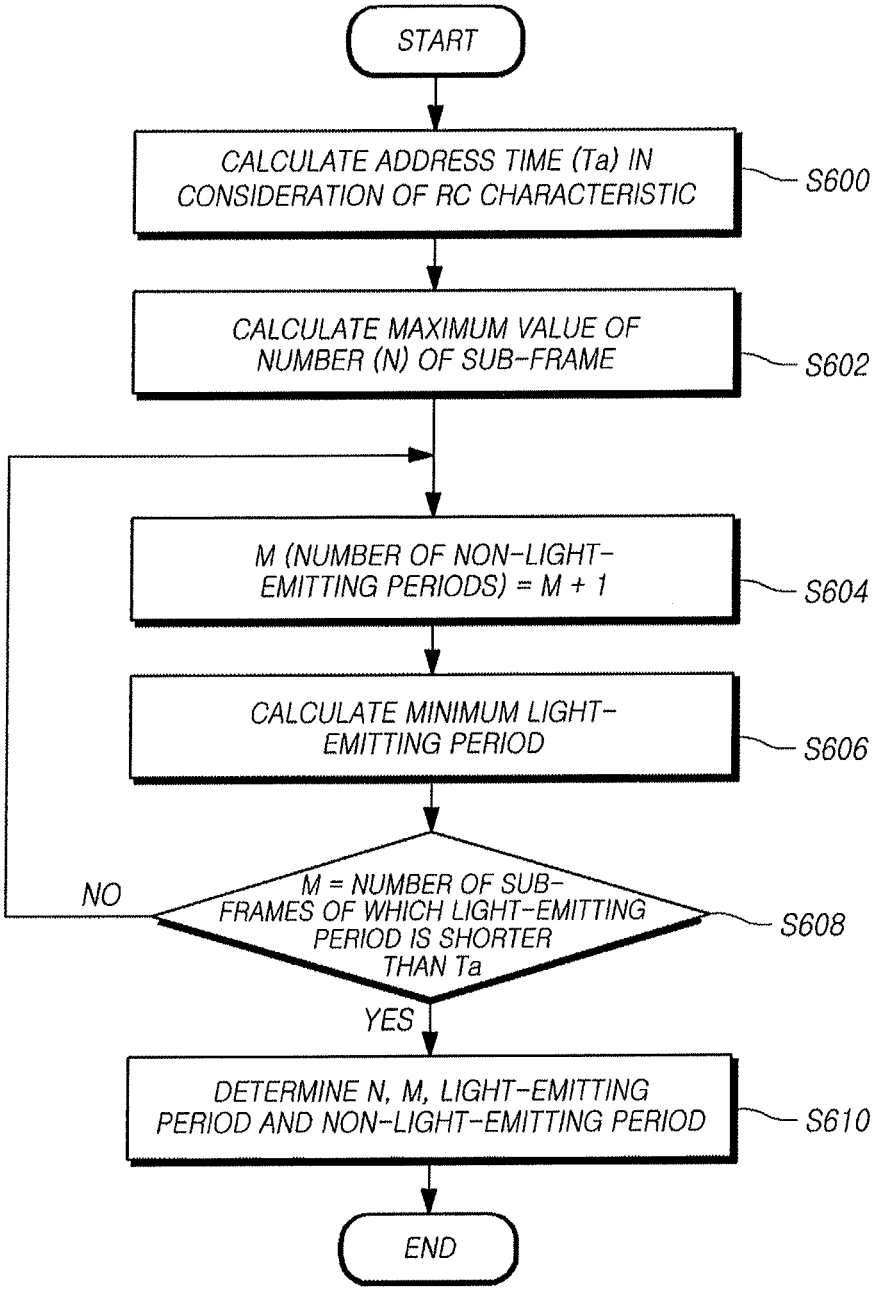
FIG. 6 is a flowchart illustrating a process for determining variable values of the digital driving manner.

FIG. 6 is a flowchart illustrating a process for determining variable values of the digital driving manner.

Referring to FIG. 6, first, the length of the writing period (Ta) is determined (S600). The length of the writing period (Ta) may be calculated in consideration of an RC characteristic of the gate lines, and at this time, equations 1 to 6 may be used.

In addition, the maximum value (Nmax) of the number of the sub-frames may be determined with reference to equation 9. When the maximum value (Nmax) of the number of the sub-frames is determined, the number of the sub-frames is determined within a value equal to or smaller than the maximum value. The number of the sub-frames may be determined within the value equal to or smaller than the maximum value with reference to a step of the grayscale. For example, when the step of the grayscale is 0 to 255, the number of the sub-frames is determined to 8.

Next, the number of the sub-frames including the non-light-emitting period and the length of the unit light-emitting period (x) are calculated through a repeat performance (i.e. an iteration).

As a first step of the repeat performance, first, increase the number (M) of the sub-frames including the non-light-emitting period by one (S604). At this time, M may be set as an initial value 0 in a step (e.g. step 600 or step S602) before step 604.

Next, the length of the unit light-emitting period (x) of which the light-emitting period is the shortest is calculated by using equation 15 or equation 16 (S606).

When the length of the unit light-emitting period (x) is calculated, the number of the sub-frames of which the length of the light-emitting period is shorter than the length of the writing period (Ta) is calculated, the number of the sub-frames is compared with the value of M determined in step S604 (S608).

When the number of the sub-frames of which the length of the light-emitting period is shorter than the length of the writing period (Ta) is different from the value of M determined in step S604 (No in step S608), move to step S604, increase the value of M and repeatedly perform step S606 and step S608.

When the number of the sub-frames of which the length of the light-emitting period is shorter than the length of the writing period (Ta) is identical to the value of M determined in step S604 (Yes in step S608), the value M is determined as a corresponding value, the length of the light-emitting period, the length of the non-light-emitting period, the number of the sub-frames and so on are finally determined (S610).

Meanwhile, the digital driving manner described with reference to FIGS. 3 to 6 is an Address While Display (AWD) manner providing the scan signal to one gate line and providing the driving voltage to the pixels connected to the corresponding gate line. In such a manner, the writing period and the light-emitting period overlap. Alternatively, a digital driving manner wherein the light-emitting period starts after the writing period ends is referred to an Address Display Separation (ADS) manner. Hereinafter, a method for calculating the length of the unit light-emitting period (x) in such an ADS manner.

Figure 7:
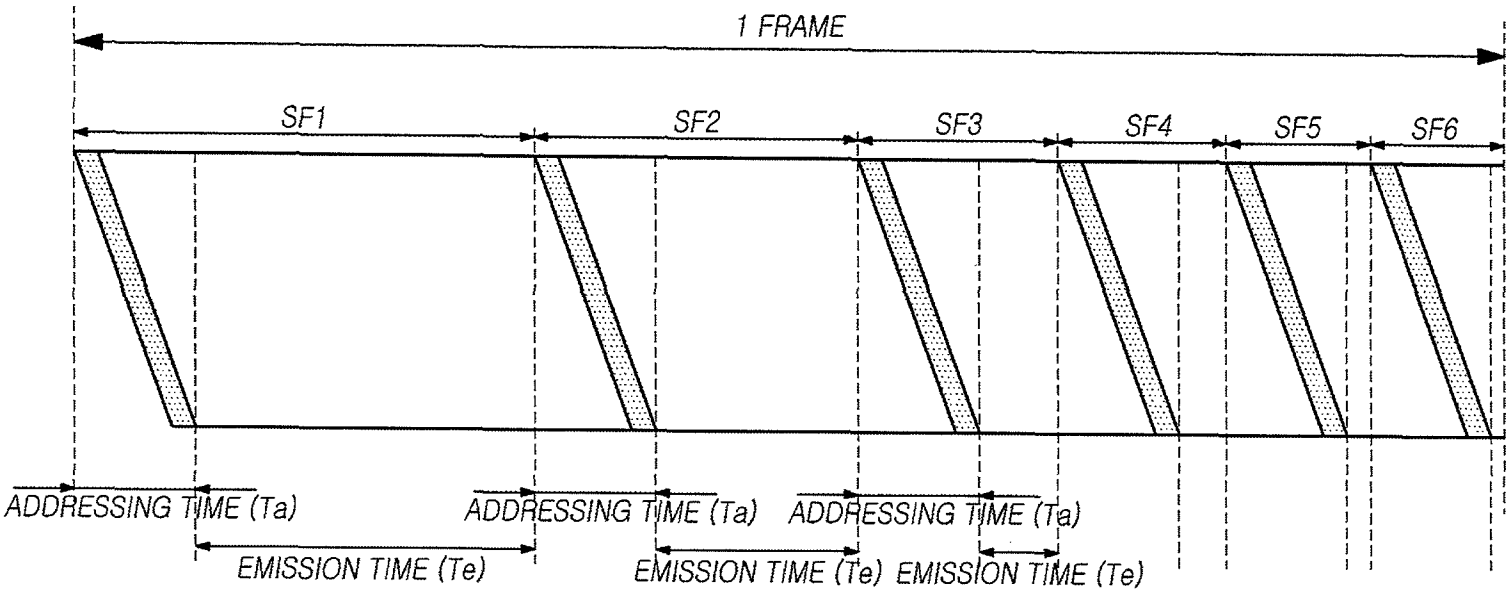
FIG. 7 is another view illustrating the sub-frames forming the one frame in the digital driving manner.

FIG. 7 is another view illustrating the sub-frames forming the one frame in the digital driving manner. FIG. 3 is the sub-frame configuration by the AWD manner, and FIG. 7 is a sub-frame configuration by the ADS manner.

Referring to FIG. 7, the light-emitting period is started after the writing period is ended in each of the sub-frames. Thus, the writing period and the light-emitting period do not overlap.

In the ADS manner, the one frame time is determined by equation 17.

$$T_{frame}=128x+64x+32x+16x+8x+4x+2x+x+8\times T_a \quad \text{Equation 17}$$

In equation 17, it is assumed that the one frame includes eight sub-frames.

Readjusting equation 17 with respect to the unit light-emitting period (x), equation 18 is obtained.

$$x=\frac{0.5\times(T_{frame}-8\times T_a)}{128\times(1-0.5^8)} \quad \text{Equation 18}$$

When equation 18 is more readjusted and the number of the sub-frames is normalized, equation 19 is obtained.

$$x=\frac{T_{frame}-N\times T_a}{2^N-1} \quad \text{Equation 19}$$

According to equation 19, in the case of the ADS manner, when the one frame time (Tframe), the number (N) of the sub-frames and the length of the writing period (Ta) are known, the length of the light-emitting period (x) may be known. The one frame time (Tframe) is determined according to the driving frequency, and the number (N) of the sub-frames is determined according to the grayscale step. Since the length of the writing period may be calculated through equations 1 to 6, all variables are determined, and thus the length of the unit light-emitting period (x) may be calculated according to equation 19.

In the above, the exemplary embodiments determining various variable values in the digital driving manner are described. The one frame is finite, therefore these variable values should be optimized in order to effectively drive the display apparatus 100. Each of the above-mentioned methods for optimizing the variable values, may be performed by logics installed in the display apparatus 100. In addition, the methods may be performed by a device (e.g a device including a recording-medium in which a program for performing the method is recorded) for designing the display apparatus 100.

Further, the terms "includes", "constitutes", or "has" mentioned above mean that a corresponding structural element is included unless they have no reverse meaning. Accordingly, it should be interpreted that the terms may not exclude but further include other structural elements. All the terms that are technical, scientific or otherwise agree with the meanings as understood by a person skilled in the art unless defined to the contrary. Common terms as found in dictionaries should be interpreted in the context of the related technical writings not too ideally or impractically unless the present disclosure expressly defines them so.

Although the embodiments of the present invention have been described for illustrative purposes, those skilled in the art will appreciate that various modifications, additions and substitutions are possible, without departing from the scope and spirit of the invention. Accordingly, the embodiments disclosed in the present invention are merely to not limit but describe the technical spirit of the present invention. Further, the scope of the technical spirit of the present invention is limited by the embodiments. The scope of the present invention shall be construed on the basis of the accompanying claims in such a manner that all of the technical ideas included within the scope equivalent to the claims belong to the present invention.

What is claimed is:

1. A method for driving an Organic Light Emitting Diode (OLED) display apparatus, the method comprising:

displaying a grayscale of one frame with N (where N is a natural number equal to or larger than two) sub-frames, each subframe including a substantially fixed length writing period and a variable length light-emitting period, wherein M (where M is a natural number smaller than N) of the sub-frames among the N sub-frames include a non-light-emitting period, and a shortest length of the variable length light-emitting period proportional to a difference between a frame time and a time obtained by multiplying a length of the writing period and M.

2. The method of claim 1, wherein the length of the light-emitting period in the specific sub-frame is inversely proportional to a difference between a value of $2^N$ and a value of $2^M$.

3. The method of claim 1, wherein the length of the light-emitting period in the specific sub-frame is calculated by a formula below, $$x=\frac{0.5\times(T_{frame}-M\times T_a)}{2^{(N-1)}\times(1-0.5^{(N-M)})}$$

where x is the length of the light-emitting period in the specific sub-frame, $T_{frame}$ is the frame time, and $T_a$ is the length of the writing period.

4. The method of claim 1, wherein the length of the writing period is proportional to an equivalent resistance and an equivalent capacitance of one gate line.

5. The method of claim 1, wherein the length of the writing period is proportional to an RC time constant of one gate line.

6. The method of claim 1, wherein the number (N) of the sub-frames displaying the one frame is equal to or smaller than a value obtained by dividing the frame time by the length of the writing period.

7. An OLED display apparatus comprising:

a display panel including a plurality of scan lines and data lines and a plurality of pixels defined by intersection of the scan lines and data lines;

a plurality of OLEDs each at a respective pixel;

a data driving unit that provides a data voltage to the data line;

a gate driving unit that sequentially provides a scan signal to the gate lines;

a timing controller that controls driving timings of the data driving unit and the gate driving; and a driving circuit unit that drives the plurality of OLEDs, wherein the driving circuit unit is configured to drive the plurality of OLEDs to display a grayscale of one frame with N where N is a natural number equal to or larger than two) of sub-frames including a substantially fixed length writing period and a variable length light-emitting period, wherein M (where M is a natural number smaller than N) sub-frames among the N sub-frames include a non-light-emitting period, and a shortest length of the light-emitting period is proportional to a difference between a frame time and a time obtained by multiplying a length of the writing period and M.

8. The OLED display apparatus claim 7, wherein the length of the light-emitting period in the specific sub-frame is inversely proportional to a difference between a value of $2^N$ and a value of $2^M$.

9. The OLED display apparatus claim 7, wherein the length of the light-emitting period in the specific sub-frame is calculated by a formula below, $$x = \frac{0.5 \times (T_{frame} - M \times T_a)}{2^{(N-1)} \times (1 - 0.5^{(N-M)})}$$

where x is the length of the light-emitting period in the specific sub-frame, $T_{frame}$ is the frame time, and $T_a$ is the length of the writing period.

10. The OLED display apparatus claim 7, wherein the length of the writing period is proportional to an equivalent resistance and an equivalent capacitance of one gate line.

11. The OLED display apparatus claim 7, wherein the length of the writing period is proportional to an RC time constant of one gate line.

12. The OLED display apparatus claim 7, wherein the number (N) of the sub-frames displaying the one frame is equal to or smaller than a value obtained by dividing the frame time by the length of the writing period.

* * * * *